US005143247A

United States Patent [19]

Gavle

[11] Patent Number: 5,143,247

[45] Date of Patent: Sep. 1, 1992

[54] LIQUID CONTAINER STABILIZING DEVICE

[76] Inventor: Ross Gavle, P.O. Box 232431, Anchorage, Ak. 99523

[21] Appl. No.: 688,675

[22] Filed: Apr. 22, 1991

[51] Int. Cl.[5] ..... B65D 21/02

[52] U.S. Cl. ..... 220/630; 220/738; 229/1.5 B

[58] Field of Search ..... 220/630, 85 H, 737, 220/738; 229/1.5 H, 1.5 B

[56] References Cited

U.S. PATENT DOCUMENTS

| | | | |
|---|---|---|---|
| 3,246,786 | 4/1966 | Holley | 229/1.5 B |
| 4,071,163 | 1/1978 | Martin | 220/630 |
| 4,726,553 | 2/1988 | Wischusen, III | 220/85 H X |
| 4,865,199 | 9/1989 | Zimmer | 220/630 X |
| 4,907,712 | 3/1990 | Stempin | 220/630 |

*Primary Examiner*—Steven M. Pollard
*Attorney, Agent, or Firm*—Frank D. Gilliam

[57] ABSTRACT

A frusto conic stabilization device, open on each end, for the stabilization of a frusto conic liquid container. The stabilization device is inverted relative to the frusto conic liquid container with the larger open end surface of the stabilization device for resting on a support surface whereby the open smaller surface of the stabilization device receives the small closed end of the liquid container therein. The liquid container is supported on or slightly elevated from the fixed surface. The weight of the container and any liquid therein, forces the liquid container to wedge downwardly in the upper stabilization device opening when the container is elevated an. When the container rests on the support surface the edges of the opening in the stabilization device should be closely adjacent to the walls of the container. A plurality of frangible recesses positioned horizontally circumferentially around the stabilization device permit it to be adapted to a variety of container sizes. The shape of the stabilization device allows for easy stacking of the device for shipping and point of sale dispensing.

8 Claims, 1 Drawing Sheet

LIQUID CONTAINER STABILIZING DEVICE

BACKGROUND OF THE INVENTION

1. Field of the Invention

This invention relates to a device for stabilizing a drinking cup filled with liquid, and more particularly a frusto conic shaped drinking cup stabilization device which may be used with a drink container for supporting and stabilizing the container.

2. Prior Art

In the ever growing food service industry, especially fast food service and convenience stores, beverages such as soda, coffee, tea, and other drinks are dispensed and sold in disposable cups. The shape of disposable liquid containers presently used for this purpose are frusto conic in vertical cross-section and have a larger top or mouth opening than the bottom closed supporting area. Such a shape results in a high center of gravity causing inherent instability of the liquid container. While the shape of the liquid containers allows for stacking and easy dispensing, these containers are "top-heavy" and thus easily tipped over by bumping the table on which they sit or by even a mild glancing blow to the top of the liquid container. This problem is especially prevalent when children are drinking from such unstable liquid containers as children for many years have shown a propensity to spill their drinks due to inattentiveness or poor coordination. It is therefor desirable to provide an easily dispensed stabilization device which when used would render such commonly used frusto conic liquid containers resistant to tipping and the resulting spillage.

U.S. Pat. No. 4,726,553 (Wischusen) discloses a drinking cup base in which a cup is placed within a recess in the cup base and forms a friction or combination friction and vacuum fit with the base. However, because of the curve at the base of the base and the size of the base it is not easily stacked for dispensing or shipping. Further, Wischusen when used as a stabilizer, elevates the supported cup above the table surface making the supported cup even more top heavy and thus requiring a greater circumference around the base of the device to adequately support the cup it encompasses.

U.S. Pat. No. 4,854,468 (Dahiquist) discloses a device for stabilizing and supporting a cup whose base diameter exceeds the diameter of a support receptacle as is normally provided in a moving vehicle. Dalquist however cannot be used on the normal flat surface or table nor is it easily stacked for dispensing and shipping.

Although the devices taught by the aforementioned prior Patents do provide different detachable support bases for fluid containers there is a continuing need for an improved liquid container stabilizer. The present invention advances the small base liquid container support art.

SUMMARY OF THE INTENTION

The present invention is directed to a frusto conic stabilizing device which is open at both the top and bottom surfaces. The stabilizing device is inverted relative to the liquid container it supports and has sufficient height from the larger diameter bottom surface to the top container receiving surface so that either the bottom of the liquid container is elevated slightly from its bottom surface or the opening in the stabilizing device is closely adjacent to the side of the container when the container is resting on the support surf ace. Generally, the largest diameter, i.e. the open top, of the liquid container will be smaller in diameter than the largest diameter surface of the stabilizing device, i.e. bottom surface. plurality of frangible recesses, placed circumferentially around the stabilizing device, allow the user of the stabilization device, by tearing away a predetermined segment along a recess, to adjust the diameter size of the upper open receiving surface to different diameters, allowing the use of the stabilization device on a variety of different diameter liquid containers.

It is the object of this invention to provide a stabilizing device which provides steadiness to otherwise top heavy conventional frusto conic shaped liquid containers.

It is the further object of this invention to proved a stabilizing device for frusto conic liquid containers which is easily adapted by the user of the support device to support a wide variety diameter frusto conic shaped liquid containers.

It is the further object of this invention to provide a stabilizing device for frusto conic liquid containers which is easily stacked for shipment to sales establishments which use such frusto conic shaped liquid containers.

It is a further object of this invention to provide a stabilizing device for liquid containers which is easily stacked in conventional style disposable drinking cup dispensers allowing easy dispensing to customers at the point of sale in establishments using disposable liquid containers.

These and other objects and advantages of the present invention will become apparent to those skilled in the art from a reading of the following detained description constructed in accordance with accompanying drawings wherein:

DESCRIPTION OF THE EMBODIMENTS

Referring now to the various drawing Figures. The stabilization device 10 of the present invention has an outer conic shaped wall 12 with a top circular shaped opening 14 and a bottom opening adjacent an open bottom surface which is larger than opening 14.

Figure 1:
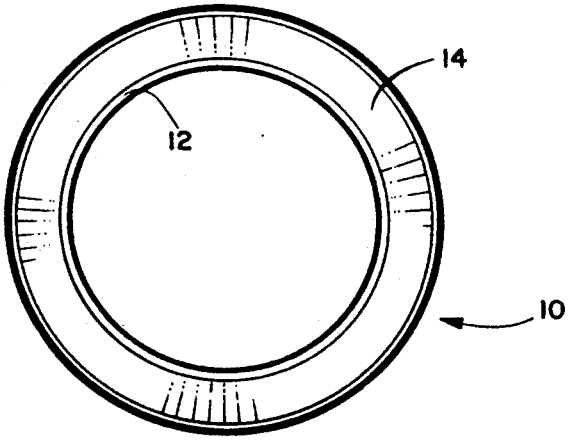
FIG. 1 is a top plan view of the liquid container stabilization device invention.
Figure 2:
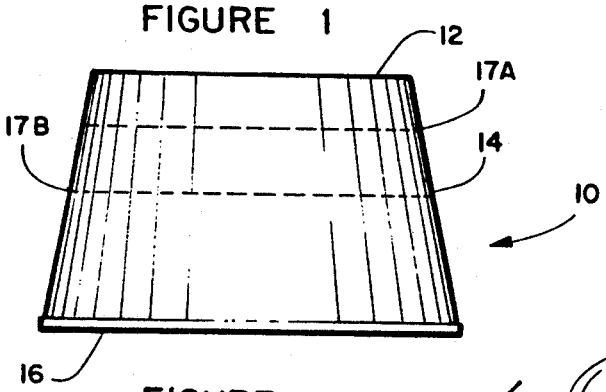
FIG. 2 is a side view of the stabilization device shown in FIG. 1.
Figure 3:
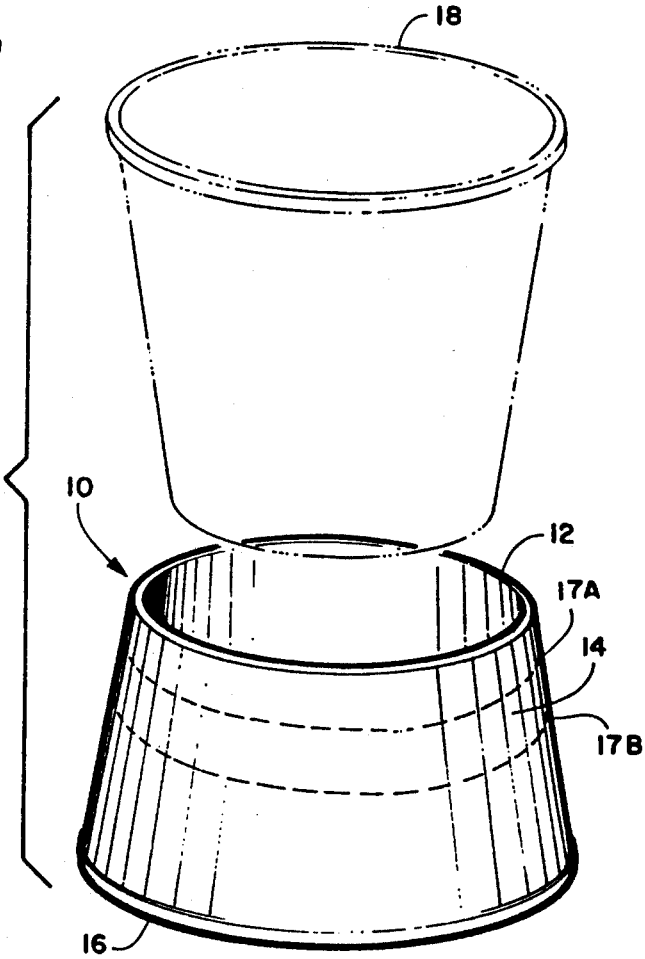
FIG. 3 is a perspective view of the liquid container stabilization device invention which shows in phantom a drinking cup for insertion into the top of the liquid container stabilization device invention.

As shown in FIG. 3, frangible recesses 17A and 17B extend circumferentially around the stabilization device. Although only two frangible recesses are shown it should be understood that any convenient number may be employed to practice this invention.

Referring again to drawing FIG. 3, a liquid container 18, shown in phantom, is positioned above the stabilization device 10, ready for insertion into the top opening 14 of the stabilization device.

In use the liquid container 18 is inserted through the top circular opening 14 of the removable stabilization device 10 until the outer wall of the liquid container either comes in contact with the inside of the top circular opening 12 and is there in held in place by a slight downward gravitational force caused by the weight of the liquid in the liquid container 18 or is resting on the same support surface as the stabilizing device and the walls of the liquid container are closely adjacent to the inside of the circular opening 14.

The liquid container 18 is selectively insertable and removable from the stabilization device 10 for drinking therefrom or the refilling thereof. The bottom surface, i.e. base, of the removable stabilization device 16, as above noted, has a larger diameter than the inserted closed bottom of the liquid container 18 thereby providing greater support against tipping of the cup than would exist without the stabilization device 10 supporting the liquid container 18.

The frangible recesses 17*a* and 17*b* allow for the adjustment of the size of the circular shaped opening 14 to accommodate a variety of different diameter drink containers 18.

In effect, a greater support footprint is provided by the stabilization device than the small closed bottom of the liquid container. The stabilization device may be constructed of any material suitable for the purpose intended. Preferably the material will be the same material from which the liquid container 18 is constructed. Styrofoam, plastic, glass or stiff waxed paper, for example and not by way of limitation, are found to be the suitable inexpensive material for such use.

Although the present invention has been shown and described with reference to particular embodiments, nevertheless, various changes and modifications obvious to one skilled in the art to which the invention pertains are deemed within the purview of the invention.

What is claimed is:

1. A stabilizing device for a frusto conic liquid container having a closed bottom surface and an open upper surface, said upper surface having a diameter greater than said bottom surface said stabilizing device comprising:

a support surface;

said stabilizing device comprises a frusto conic section having an open top and bottom surface, said bottom surface having a diameter greater than said top surface, said bottom surface rests on said support surface and said open top has a diameter selected to accept the closed bottom surface of said cup therein for support thereby; and at least one frangible recess is positioned circumferentially around the surface of said device to allow, by removal of a portion of the side wall of said stabilizing device along a selected frangible recess, for the adjustment of the diameter of said open top of said stabilizing device to accept various diameter liquid containers.

2. The device as claimed in claim 1 wherein a plurality of frangible recesses are positioned circumferentially around said stabilizing device at various elevations thereon.

3. The device as claimed in claim 1 wherein the closed bottom surface of said liquid container is supported from the support surface by the stabilizing device when inserted in said open top.

4. The device as claimed in claim 1 wherein the closed bottom surface of said liquid container is supported vertically by said support surface and the side wall thereof is closely adjacent to the edges of said open top of said stabilizing device.

5. The device as claimed in claim 1 wherein said device is constructed from styrofoam.

6. The device as claimed in claim 1 wherein said device is constructed from stiff waxed paper.

7. The device as claimed in claim 1 wherein said device is constructed from plastic.

8. The device as claimed in claim 1 wherein said device is constructed from glass.

* * * * *